United States Patent [19]

Udy et al.

[11] Patent Number: 4,528,049

[45] Date of Patent: Jul. 9, 1985

[54] SEISMIC EXPLOSIVE COMPOSITION

[76] Inventors: Lex L. Udy, 4597 Ledgemont Dr., Holladay, Utah 84117; John T. Day, 5 Dawn Hill, Sandy, Utah 84070

[21] Appl. No.: 628,809

[22] Filed: Jul. 9, 1984

[51] Int. Cl.[3] ..... C06B 45/02

[52] U.S. Cl. ..... 149/21; 149/2; 149/38; 149/41; 149/43; 149/44; 149/45; 149/46; 149/47; 149/61; 149/62; 149/71; 149/92; 149/108.2

[58] Field of Search ..... 149/2, 21, 38, 41, 43, 149/44, 47, 46, 61, 62, 45, 71, 92, 108.2

[56] References Cited

U.S. PATENT DOCUMENTS

| | | | |
|---|---|---|---|
| Re. 25,695 | 12/1964 | Cook et al. | 149/21 |
| Re. 26,804 | 2/1970 | Clay et al. | 149/43 |
| Re. 27,095 | 3/1971 | Clay et al. | 149/41 |
| Re. 28,060 | 7/1974 | Cattermole et al. | 149/2 |
| 1,720,459 | 7/1929 | Wyler | 149/43 |
| 1,827,675 | 10/1931 | Wyler et al. | 149/43 |
| 2,345,582 | 4/1944 | Carey | 52/14 |
| 2,406,573 | 8/1946 | Vogl | 260/583 |
| 2,768,073 | 10/1956 | Davidson | 52/11 |
| 2,836,484 | 5/1958 | Streng et al. | 52/15 |
| 2,860,041 | 11/1958 | Griffith, Jr. et al. | 52/11 |
| 2,930,685 | 3/1960 | Cook et al. | 52/11 |
| 2,947,618 | 8/1960 | Stengel et al. | 52/0.5 |
| 3,013,382 | 12/1961 | Doss | 60/35.4 |
| 3,031,839 | 5/1962 | Larson | 60/35.4 |
| 3,058,301 | 10/1962 | Larsen et al. | 60/35.4 |
| 3,088,272 | 5/1963 | Stengel et al. | 60/35.4 |
| 3,096,223 | 7/1963 | Cook et al. | 149/76 |
| 3,113,059 | 12/1963 | Ursenback et al. | 149/41 |
| 3,115,005 | 12/1963 | Clark | 60/35.4 |
| 3,121,036 | 2/1964 | Cook et al. | 149/41 |
| 3,125,852 | 3/1964 | Blackwell et al. | 60/35.4 |
| 3,153,606 | 10/1964 | Breza et al. | 149/41 |
| 3,155,554 | 11/1964 | Cook et al. | 149/77 |
| 3,161,551 | 12/1964 | Egly et al. | 149/46 |
| 3,212,254 | 10/1965 | Fox | 60/35.4 |
| 3,249,474 | 5/1966 | Clay et al. | 149/6 |
| 3,249,476 | 5/1966 | Clay et al. | 149/38 |
| 3,249,477 | 5/1966 | Clay et al. | 149/41 |
| 3,282,752 | 11/1966 | Clay et al. | 149/22 |
| 3,282,753 | 11/1966 | Cook et al. | 149/46 |
| 3,287,189 | 11/1966 | Wilson et al. | 149/8 |
| 3,288,658 | 11/1966 | Ferguson et al. | 149/2 |
| 3,331,717 | 7/1967 | Cook et al. | 149/38 |
| 3,356,547 | 12/1967 | Berthmann et al. | 149/51 |
| 3,367,805 | 2/1968 | Clay et al. | 149/6 |
| 3,379,587 | 4/1968 | Cook | 149/39 |
| 3,382,117 | 5/1968 | Cook | 149/39 |
| 3,390,031 | 6/1968 | Albert | 149/45 |
| 3,390,032 | 6/1968 | Albert | 149/45 |
| 3,409,484 | 11/1968 | Minnick | 149/21 |
| 3,419,443 | 12/1968 | Maes | 149/1 |
| 3,431,155 | 3/1969 | Dunglinson et al. | 149/47 |
| 3,447,978 | 4/1969 | Bluhm | 149/2 |
| 3,453,158 | 7/1969 | Clay | 149/41 |
| 3,459,608 | 8/1969 | Ludolphy et al. | 149/56 |
| 3,471,346 | 10/1969 | Lyerly | 149/47 |
| 3,473,983 | 10/1969 | Cook et al. | 149/41 |
| 3,485,686 | 12/1969 | Jessop et al. | 149/41 |

FOREIGN PATENT DOCUMENTS

| | | | |
|---|---|---|---|
| 902369 | 6/1972 | Canada | 52/10 |
| 163946 | 6/1921 | United Kingdom . | |

OTHER PUBLICATIONS

Burton et al., "Perchloric Acid and Some Organic Perchlorates", 4 Analyst 15, (Jan. 1955).

Fedorof and Scheffield, Encyclopedia of Explosives and Related Items, vol. 7, (1975).

Hercules, Surf-A-Seis TM High Explosive Bulletin.

Thermex Energy, Thermex 200FR Series—Pouches.

Thermex Energy, Thermex Explosives.

*Primary Examiner*—Stephen J. Lechert, Jr.

[57] ABSTRACT

A dry explosive seismic composition which can be initiated by low grain detonating cord so as to minimize the fire hazards typically associated with seismic testing. Preferred compositions within the scope of the present invention include a sensitizer of Hexamine or a derivative thereof, such as Hexamethylenetetramine Mononitrate. The compositions of the present invention not only reduce the fire hazards associated with using such compositions, but they also resist vaporization of the sensitizer, thereby minimizing the problems associated with handling the compositions.

12 Claims, No Drawings

SEISMIC EXPLOSIVE COMPOSITION

BACKGROUND

1. The Field of the Invention

The present invention relates to explosives, and more particularly, to dry explosives for use in developing surface seismic shock energy.

2. The Prior Art

Surface seismic shock explosives have been widely accepted as a preferred means of inducing shock waves into the earth. The shock waves, according to known techniques, are reflected by subsurface geological strata and detected again at or near the surface of the earth using detectors, such as geophones. Analysis of the reflected shock waves permits skilled analysts to gain valuable geological information which, among other uses, assists in the discovery of subsurface gas and oil.

The explosive composition which is used to induce the shock wave into the earth must develop the necessary shock energy, while at the same time permit safe and facile handling. Several prior art products have been developed to address these characteristics. Examples of such prior art products are "Thermex, " sold by Thermex Energy Corporation, and "Surf-a-seis," sold by Hercules, Incorporated.

Prior art compositions of dry explosive are typically packaged in a flexible plastic bag which is suspended upon a ground stake and tied with high grain (25 to 30 grains of PETN per foot) detonating cord. The detonating cord initiates the seismic explosive, which in turn generates the shock wave.

Typically, seismic explosives are used in field environments which give rise to serious concern about fire. In the typical circumstance, plastic containers of seismic explosives are placed on wooden stakes and spaced in an array at a site to be tested. It is not uncommon for the site to be covered with dry grass and foliage which creates a serious fire hazard when seismic explosives are used. One contributor to the fire hazard is the high grain detonating cord which is required to initiate many of the prior art seismic compositions.

To minimize the fire hazard, some prior art products are sold with a pouch of fire retardant to be placed on the positioning stake below the explosive prior to initiation. When the explosive shoots, the retardant is designed to quench any fire which is ignited. The retardant, however, increases the cost and the complexity of seismic exploration.

The prior art compositions each use an oxidizer and a fuel mixed together with a sensitizer, such as finely divided aluminum. However, finely divided (paint grade) aluminum is expensive and cannot be used alone reliably so as to be both safe in handling and reliable in initiating. Accordingly, prior art compositions typically include a Nitroparaffin sensitizer, such as 1-Nitropropane, which are liquids with high vapor pressures. When carefully mixed with the dry fuel and oxidizers, Nitroparaffins can effectively increase the sensitivity.

Liquid Nitroparaffins, however, used in the prior art compositions disadvantageously tend to vaporize under higher temperature conditions, thereby causing the plastic bag containing the composition to swell. Thus, special care and expense must be invested in each packaging bag to assure that margins and openings are sealed against the increased vapor pressure inside the bags.

Unless the bag is specially sealed, it will rupture and the Nitroparaffin will evaporate.

It would, therefore, be a significant imporvement in the art to provide a dry surface seismic composition which reliably initiates with lower grain detonating cord and which is also safe and easy to handle without the attendant problems presented by the prior art compositions. Such an explosive composition is disclosed and claimed herein.

BRIEF SUMMARY AND OBJECTS OF THE INVENTION

The present invention is directed to novel dry explosive compositions which can be initiated by standard detonating cords of the low grain variety, but which are also safe and easy to handle.

Preferred embodiments of the present invention are dry explosive compositions of the present invention which include a Hexamine sensitizer. The resultant compositions control sensitivity without the use of liquid sensitizers which tend to vaporize and swell the packaging bags.

It is, therefore, a primary object of the present invention to provide an improved, dry, seismic explosive composition.

A further primary object of the invention is to provide a seismic explosive which can be initiated by low grain detonation cord so as to reduce fire hazard typically associated with high grain detonation cord.

Another important object is to provide a seismic explosive admixture having controlled sensitivity with superior safety and handling characteristics.

It is another important object of the present invention to provide a dry seismic explosive which will not become desensitized over a wide temperature range.

A still further object is to provide a dry seismic explosive admixture which does not vaporize to swell the bags containing the mixture.

These and other objects and features of the invention will become more fully apparent from the following description and appended claims.

DETAILED DESCRIPTION OF THE PREFERRED EMBODIMENTS

Preferred embodiments of the present invention include at least one oxidizer, at least one fuel, and a unique mixture of dry sensitizers which can be selected to safely permit initiation of the composition with low grain (12 and less) detonating cord.

As an oxidizer, Ammonium Nitrate is preferred, because it is inexpensive and readily available. The Ammonium Nitrate is supplemented with another suitable nitrate such as Potassium Nitrate, Sodium Nitrate or Lead Nitrate which improves overall oxidation capacity and acts as a physical barrier to aid in minimizing caking of the Ammonium Nitrate. Sodium Nitrate has also been found to be an acceptable oxidizer. The oxidizers are ground to approximately 100 mesh and mixed together.

Any one of a variety of fuels may be added to the oxidizer mix. Granular aluminum and Gilsonite have been found to be effective. Other suitable fuels include coal dust, cellulose materials from a variety of origins; even sugar has been found to be acceptable for many situations. The amount of fuel may vary depending upon the stoichiometry of the total composition, but the amount of fuel in the composition is typically in the range of from about 1% to about 10% by weight.

In the embodiment described herein, it has been found desirable to add a small amount of fumed silica to minimize crystallization and caking of the Ammonium Nitrate. Commercially available silica sold under the trade names "Cab-o-Sil" and "Aerosil" are suitable for use in the present invention. Silica added in an amount up to about 0.3% will maintain the Ammonium Nitrate in a fine-dry powdered form, without adversely affecting sensitivity.

The sensitivity of the oxidizer/fuel mixture is improved with Hexamine, or a selected derivative thereof, in amounts in the range of from about 5% to about 8%. When the Hexamine is dispersed throughout the dry mix, the resulting composition was found to be safe and effective; equally important, the resulting composition can be reliably initiated with a number 8 blasting cap.

Desirably, a fire retardant may be incorporated into the composition to absorb energy and decrease the temperature of the explosive reaction. Sodium Chloride and phosphates have been found to be effective when used in concentrations of about 1% to 25%.

This composition, however, requires additional sensitization in order for initiation to be achieved with a low grain detonating cord. Increased sensitivity is accomplished by adding a small amount of finely divided (paint grade) aluminum in sufficient amounts that the composition will initiate with a 7½ to 12 grain detonating cord.

The following examples illustrate the invention:

EXAMPLE 1

A composition within the scope of the present invention was prepared by thoroughly mixing the following ingredients in the indicated corresponding amounts:

| Ingredient | Percent Composition |
|---|---|
| Ammonium Nitrate | 80% |
| Potassium Nitrate | 10% |
| Aerosil | 0.2% |
| Hexamine | 6.3% |
| Paint Grade Aluminum | 1.5% |
| Gilsonite | 2% |

This composition resulted in a dry mix of powder to fine granular consistency which resisted caking. When sealed in a plastic bag and exposed to temperatures up to 140° F., the composition resisted vaporization. No swelling of the packaging bag was noted, and no vaporization of the sensitizer could be detected. The composition initiated reliably with a 7½ grain detonating cord.

EXAMPLE 2

Another composition within the scope of the present invention is made by mixing the following ingredients in the indicated corresponding amounts:

| Ingredient | Percent Composition |
|---|---|
| Ammonium Nitrate | 70% |
| Potassium Nitrate | 19% |
| Hexamine | 8% |
| Paint Grade Aluminum | 0.5% |
| Gilsonite | 2.5% |

The resulting composition is a dry mix in which caking is minimal. In addition, the composition resists vaporization under conditions such as those set forth in Example 1. The composition of this Example is capable of reliable initiation using a 25 grain detonating cord.

EXAMPLE 3

Another composition within the scope of the present invention is made by mixing the following ingredients in the indicated corresponding amounts:

| Ingredient | Percent Composition |
|---|---|
| Ammonium Nitrate | 89% |
| Aerosil | 0.3% |
| Hexamine | 5% |
| Paint Grade Aluminum | 3.0% |
| Gilsonite | 2.7% |

The resulting composition has essentially the same physical characteristics as the composition of Example 2, and it is capable of reliable initiation with a 7½ grain detonating cord.

EXAMPLE 4

Another composition within the scope of the present invention is made by mixing the following ingredients in the indicated corresponding amounts:

| Ingredient | Percent Composition |
|---|---|
| Ammonium Nitrate | 89% |
| Aerosil | 0.3% |
| Hexamine | 6.7% |
| Paint Grade Aluminum | 1% |
| Gilsonite | 3.0% |

The resulting composition has essentially the same physical characteristics as the composition of Example 2, and it is capable of reliable initiation with an 18 grain detonating cord.

EXAMPLE 5

Other compositions within the scope of the present invention were made according to the procedures of Example 1, except that the percent composition of fuel was varied in the range of from about 1% to about 3%. The variance in the amount of fuel did not significantly adversely affect the shooting (initiation) characteristics of the compositions.

EXAMPLE 6

Another composition within the scope of the present invention was made according to the procedures of Example 1, except that a Hexamine derivative was utilized as the sensitizer. The derivative of Hexamine was prepared by adding dilute nitric acid to the Hexamine. The resulting Hexamethylenetetramine Mononitrate was substituted for the Hexamine in the composition of Example 1.

The resulting composition possessed the same advantageous physical characteristics as the composition in Example 1 and was initiated reliably with a 12 grain detonating cord.

EXAMPLE 7

A composition within the scope of the present invention was prepared by mixing the following components in the indicated amounts:

| Ingredient | Parts Composition |
|---|---|
| Ammonium Nitrate | 75 |
| Aerosil | 0.2 |
| Hexamine | 6.3 |
| Paint Grade Aluminum | 1.5 |
| Gilsonite | 2 |
| Sodium Chloride | 25 |

This composition initiates reliably with a 12 grain detonating cord and advantageously decreases the temperature of the reaction significantly over that resulting from initiation of the composition of Example 1.

EXAMPLE 8

The composition of Example 1 was modified to substitute Lead Nitrate for the Potassium Nitrate. The composition initiated with a 12 grain detonating cord.

EXAMPLE 9

The composition of Example 1 was modified to substitute Sodium Nitrate for the Potassium Nitrate. The composition initiated with a 12 grain detonating cord.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A dry seismic explosive composition comprising:
- an admixture of at least one oxidant having a total percentage composition in the range of from about 70% to about 90% by weight;
- at least one fuel having a percentage composition in the range of from about 1% to about 3% by weight;
- hexamine sensitizer having a percentage composition in the range of from about 5% to about 8% by weight; and
- finely divided aluminum having a percentage composition sufficient to initiate the explosive composition with a detonating cord having not more than 18 grains of pentaerythritol tetranitrate per foot.

2. A dry seismic explosive composition as defined in claim 1 further comprising fumed silica having a percentage composition in an amount up to about 0.3% by weight.

3. A dry seismic explosive composition as defined in claim 1 wherein the percent composition of finely divided aluminum is in the range of from about 0.5 to about 3% by weight.

4. A dry seismic explosive composition as defined in claim 1 wherein the oxidant is selected from the group consisting of ammonium nitrate, potassium nitrate, sodium nitrate and lead nitrate.

5. A dry seismic explosive composition as defined in claim 1 wherein the oxidant comprises ammonium nitrate having a percentage composition in the range of from about 70% to about 90% by weight and potassium nitrate having a percentage composition in an amount up to about 20% by weight.

6. A dry seismic explosive composition as defined in claim 1 wherein the fuel is selected from the group consisting of gilsonite, coal dust and sugar.

7. A dry seismic explosive composition comprising:
- an admixture of at least one oxidant having a total percentage composition in the range of from about 70% to about 90% by weight;
- at least one fuel having a percentage composition in the range of from about 1% to about 3% by weight; and
- hexamine having a percentage composition of not more than 10%.

8. A dry seismic explosive composition comprising:
- an admixture of at least one oxidant having a total percentage composition in the range of from about 70% to about 90% by weight;
- at least one fuel having a percentage composition in the range of from about 1% to about 3% by weight;
- a sensitizer in a percentage composition in the range of from about 5% to about 8% by weight, said sensitizer being a derivative of hexamine; and
- finely divided aluminum having a percentage composition sufficient to initiate the explosive composition with a detonating cord of not more than 18 grains of pentaerythritol tetranitrate per foot.

9. A dry seismic explosive composition as defined in claim 8 wherein the sensitizer is hexamethylenetetramine mononitrate.

10. A dry explosive composition consisting essentially of:
- ammonium nitrate having a concentration in the range of from about 70% to about 90% by weight;
- potassium nitrate having a concentration up to about 20% by weight;
- fumed silica having a concentration up to about 0.3% by weight;
- finely divided aluminum having a concentration in the range of from about 0.5% to about 3% by weight;
- gilsonite in a concentration in the range of from about 1% to about 3% by weight; and
- a sensitizer selected from the group consisting of hexamine and hexamethylenetetramine mononitrate, said sensitizer having a concentration in the range of from about 5% to about 8% by weight.

11. A dry seismic explosive composition comprising:
- an admixture of at least one oxidant having a total percentage composition in the range of from about 70% to about 90% by weight;
- hexamine sensitizer having a percentage composition in the range of from about 5% to about 8% by weight; and
- aluminum having a percentage composition sufficient to initiate the explosive composition with a detonating cord having not more than 18 grains of pentaerythritol tetranitrate per foot.

12. A dry seismic explosive composition as defined in claim 11 wherein the percent composition of aluminum is in the range of from about 0.5 percent to about 6 percent by weight.

* * * * *